United States Patent [19]

Hansson

[11] 4,298,317

[45] Nov. 3, 1981

[54] OVERSPEED SAFETY DEVICE

[75] Inventor: Gunnar C. Hansson, Stockholm, Sweden

[73] Assignee: Atlas Copco Aktiebolag, Nacka, Sweden

[21] Appl. No.: 82,575

[22] Filed: Oct. 9, 1979

[30] Foreign Application Priority Data

Oct. 11, 1978 [SE] Sweden ..... 7810607

[51] Int. Cl.[3] ..... F01B 25/02

[52] U.S. Cl. ..... 418/43; 137/50; 137/57

[58] Field of Search ..... 91/59, 435, 458; 137/50, 56, 57; 415/41; 418/41, 42, 43

[56] References Cited

U.S. PATENT DOCUMENTS

| | | | |
|---|---|---|---|
| 3,020,920 | 2/1962 | Kaman | 137/50 |
| 3,071,115 | 1/1963 | Schott | 418/42 |
| 3,257,913 | 6/1966 | Broom et al. | 418/43 |
| 3,279,485 | 10/1966 | Alexander | 415/41 X |
| 3,749,530 | 7/1973 | Amador | 418/41 |
| 3,930,764 | 1/1976 | Curtiss | 418/43 |

*Primary Examiner*—Gerald A. Michalsky
*Attorney, Agent, or Firm*—Frishauf, Holtz, Goodman and Woodward

[57] ABSTRACT

In a pneumatically powered grinding machine provided with a flyweight operated speed governor there is incorporated an independently operating overspeed safety device which in case of malfunction of the speed governor is intended to obstruct further motive air supply to the motor of the machine. The overspeed safety device comprises an annular valve disk having two centrifugal weights which together with a suspender plate form a latch means by which the valve disk is kept in its open position at motor speeds not exceeding a predetermined level. In its open position, the valve disk is elastically bent about a diameter line as a result of the latch engagement between the centrifugal weights and the suspender plate. When the predetermined speed limit is reached, the valve disk is released from the suspender plate to occupy, while resuming its original flat shape, an air supply obstructing, closed position. The safety device is not resettable without dismantling the machine.

10 Claims, 6 Drawing Figures

OVERSPEED SAFETY DEVICE

BACKGROUND OF THE INVENTION

This invention relates to an overspeed safety device for a pneumatic motor. In particular the invention relates to a safety device comprising a rotating annular valve disk provided with means responsive to centrifugal action to shift the valve disc from an open position to a closed position at a predetermined speed level.

In certain pneumatic motor installations, as for example in grinding machines, it is of greatest importance that not only the machine but in particular the working tool connected thereto is effectively prevented from overspeed at idle running. If the motor speed in grinding machines is allowed to increase above a certain level there is great risk that the grinding tool, when exposed to severe centrifugal forces, will break up into pieces and, thereby, put personnel and equipment in danger. In order to avoid the risk of damage due to overspeed, machines of this type are equipped with speed governors.

Speed governors for this purpose, however, are mechanical and under certain conditions, when exposed to hard wear, rust and dirt, they easily get out of order.

In order to obtain a safe protection for personnel and equipment there have been suggested overspeed safety devices which act independently of the speed governors to shut off the pressure air supply to the motor at a speed level above the normal speed governor activation level.

A safety device of this type is previously shown and described in German Patent Publication DOS 2303942. This prior art safety device comprises a conical steel disk attached to the rotating spindle of a pneumatic motor and provided with a number of centrifugal weights rigidly attached along the periphery of same. As the spindle and the valve disk reaches a predetermined speed level the centrifugal action upon the centrifugal weights forces the steel disk to snap over and assume the shape of a cone facing the opposite direction. In its latter position the steel disk covers the air inlet of the pneumatic motor and interrupts further pressure air supply to the motor.

This known device is characterized by its frictionless action and that the speed level at which the device has to be closed is determined just by the shape or pretension of the steel disk and the mass of the centrifugal weights mounted on the disk. It is an advantage for a mechanism like this to operate frictionless, but a disadvantage inherent in this device is the difficulty in accurately predetermining the shut-off speed level. Another drawback of this known device is that, since no positively acting holding means is associated with the valve disk, the latter might be shifted from open to closed position or vice versa by external activation, like for instance a blow on the outside of the housing in which the device is enclosed.

The object of the present invention is to overcome the above mentioned problems and create a valve which is exposed to a minimum of friction and which is activated at a very well defined speed level.

SUMMARY OF THE INVENTION

In accordance with the present invention, a pneumatic motor comprises a rotor drivingly connected to an output spindle; a pressure air supply passage; at least one air inlet opening to the motor; and an overspeed safety device including a rotating annular valve disk which is elastically deformable and disposed within the pressure air supply passage for axial displacement between an open position and a closed position in which closed position it at least partly covers said at least one air inlet opening. The improvement of the invention resides in that the overspeed device further comprises releasable latch means coupled to the valve disk to retain the valve disk in its open position at motor speeds below a predetermined speed; the latch means comprising at least two holding dogs attached to the valve disk and a suspender means rigidly attached to the rotor of the motor, the holding dogs being at normal motor speed urged into latching engagement with the suspender means by a spring force obtained by elastic preforming of the elastically deformable valve disk, and the holding dogs being responsive to centrifugal action at motor speeds exceeding the predetermined speed to elastically deform the valve disk to release the latching engagement of the holding dogs with the suspender means to thereby permit the valve disk to move towards its closed position.

An embodiment of the invention is hereinbelow described in detail with reference to the drawings.

DETAILED DESCRIPTION

Figure 1:
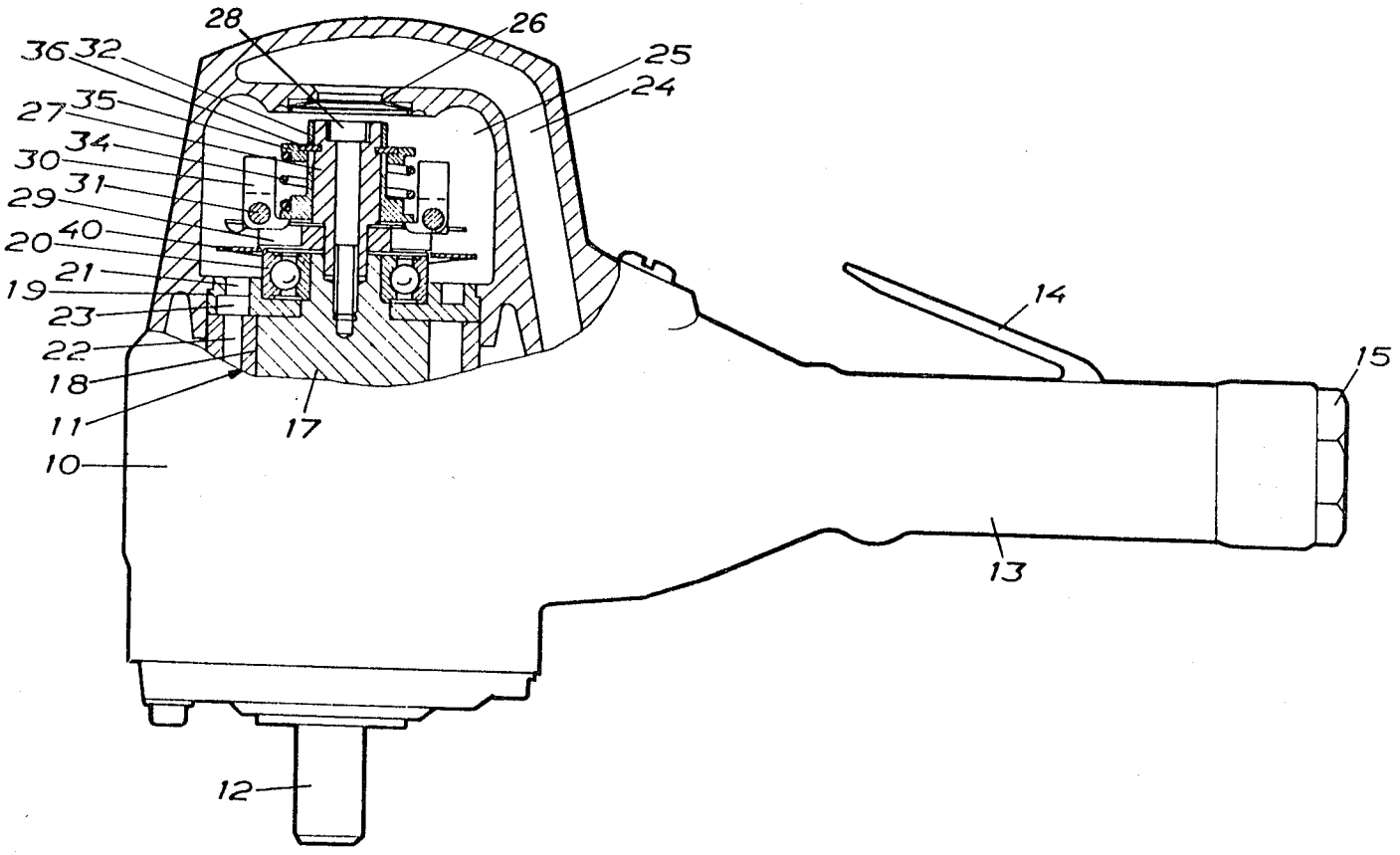
FIG. 1 shows a partly broken side elevation of a rotary grinding machine provided with a speed governor and an overspeed safety device according to the invention.

The grinding machine shown in FIG. 1 comprises a housing 10 and a pneumatic vane motor 11 rotating an output spindle 12. The housing 10 is formed with a handle 13 in which there is supported a throttle valve (not shown) to be operated by a trigger lever 14. At the outer end of the handle 13 there is a nipple 15 for connection of a pressure air supply conduit.

Figure 2:
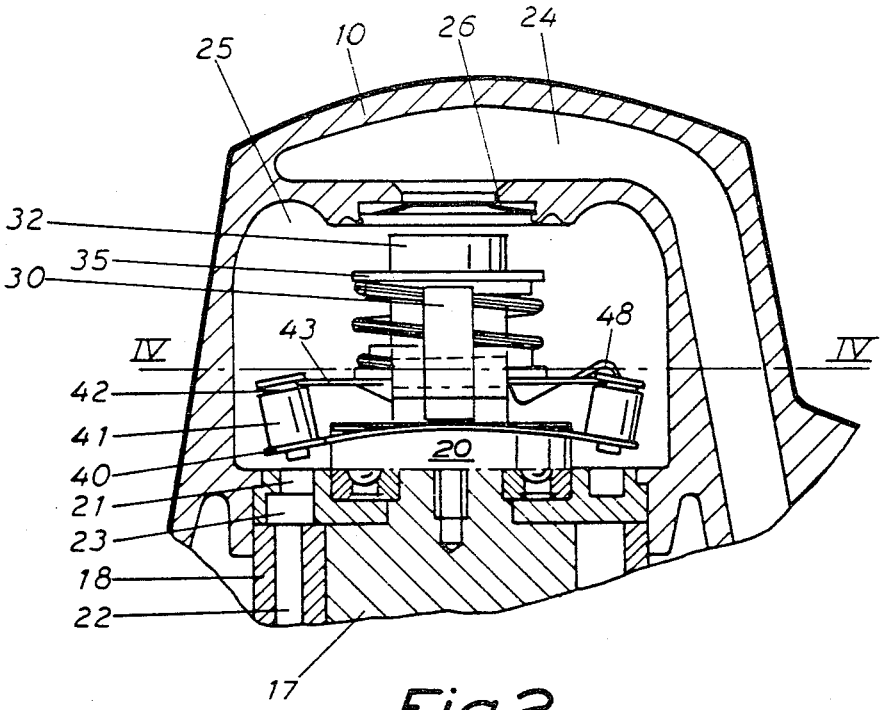
FIG. 2 shows, in larger scale, a section through a part of the machine shown in FIG. 1, wherein the motor rotor is turned 90 degrees so as to expose the overspeed safety device. The latter is shown in its open position.
Figure 3:
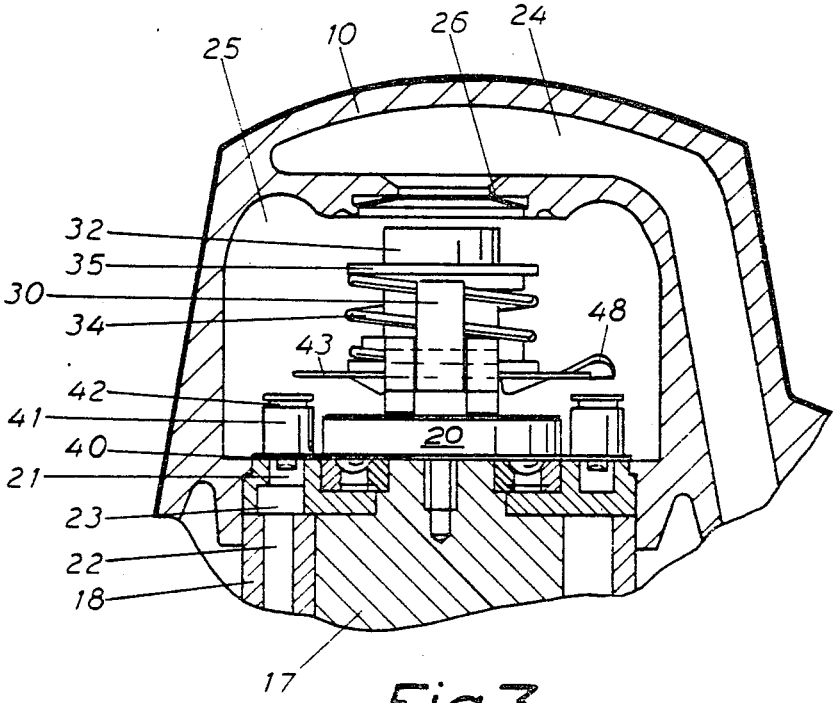
FIG. 3 shows the same section as FIG. 2 but illustrates the safety device in its closed position.

As seen in FIGS. 2 and 3, the pneumatic vane motor 11 comprises a rotor 17, a cylinder 18, a rear end plate 19 and a ball bearing 20 for rotationally supporting the rotor 17 relative to the end plate 19. On its upper side, the end plate 19 is provided with an annular groove 21 which communicates with an air inlet passage 22 in the cylinder 18 via an opening 23.

The housing 10 is provided with an air supply passage 24 which includes a regulator chamber 25 and an intermediate opening 26. The opening 26 is controlled by a speed governor of a conventional design which is situated within the regulator chamber 25 and which is rigidly secured to the rotor 17 of the motor 11. The speed governor comprises a hub 27 secured to the rotor 17 by means of a co-axial screw 28. The hub 27 rotatively supports a carrier member 29 which via pivot pins 31 pivotably supports two flyweights 30. The flyweights 30 are arranged to axially move a valve sleeve 32 so as to restrict the supply of pressure air through the opening 26. The valve sleeve 32, however, is biased against the action of the flyweights 30 by a coil spring 34 which at its upper end is supported against a washer 35. The latter is secured to the hub 27 (FIG. 1) by lock pins 36.

Within the regulator chamber 25 there is also situated the overspeed safety device which comprises an annular valve disk 40 preferably made of spring steel and having an internal diameter exceeding the outer diameter of the ball bearing 20. Thereby the valve disk 40 is free to move axially outside the ball bearing 20 between an open position (FIG. 2) and a closed position (FIG. 3). The annular valve disk 40 is provided with two oppositely mounted centrifugal weights 41 each of which is cylindrical in shape and provided with an annular groove 42, at its free end.

Figure 4:
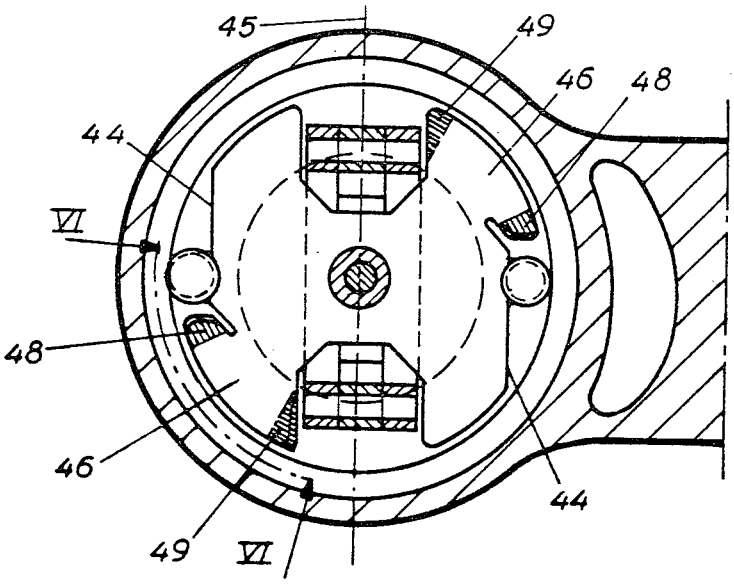
FIG. 4 shows a cross section along line IV—IV in FIG. 2.
Figure 5:
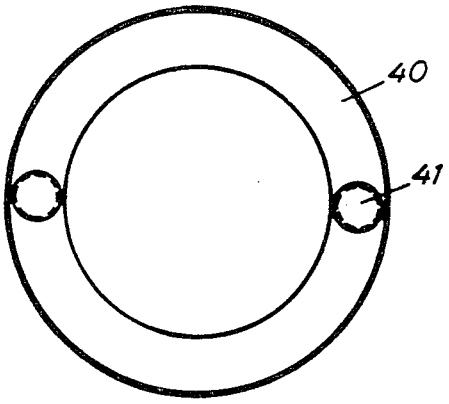
FIG. 5 shows a horizontal view of the valve disk of the overspeed safety device.

The overspeed safety device further comprises a suspender plate 43 rigidly secured to the hub 27 to be co-rotative with the motor rotor 17. As illustrated in FIG. 4, the suspender plate 43 is provided with two opposite, parallel edges 44 which are arranged to be engaged by the grooves 42 of the centrifugal weights 41.

As the distance between the edges 44 is longer than the shortest distance between the bottoms of the grooves 42, when the valve disk 40 is in its open condition (FIG. 3), an interengagement of the centrifugal weights 41 and the edges 44 results in an elastic bending of the valve disk 40 about a diameter line 45 (see FIGS. 2 and 4).

The centrifugal weights 41 and the suspender plate 43 form a latch means by which the valve disk 40 is retained in its open position at motor speeds not exceeding said predetermined limit. The centrifugal weights 41 thereby have the double purpose of being the holding dogs of a latch mechanism and the speed responsive means for deactivation of said latch mechanism.

Figure 6:
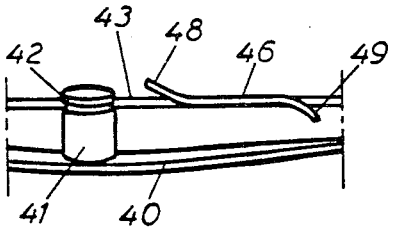
FIG. 6 shows a detail of the safety device viewed as from line VI—VI in FIG. 4.

Moreover, the suspender plate 43 is formed with two diametrically opposite wings 46 which comprise inclined end portions 48, 49, (see FIG. 6). By means of their upwardly inclined forward end portions 48 and downwardly inclined rear end portions 49, the wings 46 are intended to act upon the upper ends of the centrifugal weights 41 so as to urge the valve disk 40 downwardly towards the rear end plate 19 of the motor 11 as the valve disk 40 is released from its normal, suspended position and a relative rotation between the valve disk 40 and the suspender plate 43 arises.

In operation, the machine as illustrated in the drawing figures, is supplied with pressure air via nipple 15, throttle valve within the handle 13 and the supply passage 24. Further, pressure air passes through the opening 26 and the regulator chamber 25 past the speed governor and the overspeed safety valve, through the opening 23 in the rear end plate 19 and into the inlet passage 22 in the motor cylinder 18. The motor 11 is thereby energized and a grinding tool attached to the output spindle 12 is brought to rotate. Under normal conditions, the speed governor continuously controls the air supply to the motor in response to the actual motor speed. This means that when the machine is running under idle conditions, i.e. no working load is applied on the grinding tool connected to the output spindle 12, the flyweights 30 are pivoted outwardly, thereby urging the valve sleeve 32 upwards to restrict the air supply passage through the opening 26. The speed governor thereby protects the motor and the grinding tool connected to the output spindle 12 from attaining overspeed.

As an extra safety measure, the overspeed safety device according to the invention is arranged to act independently of the speed governor. The release speed level of the safety device is a bit higher than the speed level at which the speed governor restricts the air supply to the motor. Thereby, the safety device is not activated as long as the speed governor operates correctly. So, under normal conditions and at correct speed governor operation the safety valve disk 40 has almost no influence upon the pressure air supply to the motor. The valve disk 40 is kept in a suspended position in which the centrifugal weights 41 engage the edges 44 of the suspender plate 43. As illustrated in FIG. 2, the valve disk 40 is bent about a diameter line 45, such that the bending resisting spring force of the valve disk 40 is active in maintaining the engagement between centrifugal weights 41 and plate 43. As long as the speed governor operates properly the valve disk 40 is maintained in its suspended position and the centrifugal forces acting upon the weights 41 are not strong enough to separate the weights 41 from the edges 44 of the suspender plate 43.

The moment the speed governor, for one reason or another, stops operating properly and the motor speed is allowed to attain a non-permittably high level, the centrifugal forces acting on the centrifugal weights 41 will be strong enough to further separate the weights 41 against the spring action of the valve disk 40 such that the enggement between the suspender plate 43 and the grooves 42 is broken. Now, the valve disk 40 is free to move toward its closed position in which it covers the annular groove 21 of the rear end plate 19, thereby breaking the motive air communication between the air supply passage 24 and the inlet passage 22 of the motor cylinder 18.

The valve disk 40 is moved toward its closed position partly by the action of the inclined forward and rear end portions 48 and 49, respectively, of the wings 46 and partly by the influence of a motive air pressure drop existing across valve disk 40. To a certain extent such a pressure drop exists even in the open position of the valve disk.

As the latch mechanism, consisting of the centrifugal weights 41 and the suspender plate 43, has been released due to passing of the predetermined speed limit, the valve disc 40 is shifted from its open to its closed position, thereby obstructing further supply of motive air to the motor 11. The valve disk 40 can not be reset to its open position without dismantling the machine, which is necessary in order to repair the malfunctioning speed governor.

Due to the positive latch engagement between the valve disc 40 and the suspender plate 43, there is no risk the overspeed safety device is unintentionally activated. Neither is it possible to reset the valve mechanism without dismantling the machine which is important since it makes it necessary to take the malfunctioning machine out of work for overhaul.

The latch mechanism for retaining the valve disc 40 also facilitates the determination of the speed level at which the safety device shall be activated. It is important that this speed level is accurately determined and that the safety device is able to be set at that very speed level. If the safety device is set to release at too a low speed it may act in advance of the ordinary speed governor and will cause an unnecessary dismantling of the machine. If on the other hand, it is set to release at too a high speed it may not be able at all to prevent the kind of damage it is intended to prevent.

What we claim is:

1. In a pneumatic motor (11), comprising a rotor (17) drivingly connected to an output spindle (12); a pressure air supply passage (24); at least one air inlet opening (23) to the motor (11); and an overspeed safety device including a rotating annular valve disk (40) which is elastically deformable and disposed within the pressure air supply passage for axial displacement between an open position and a closed position in which closed position it at least partly covers said at least one air inlet opening (23);

the improvement wherein said overspeed device further comprises:

releasable latch means (41,42,43) coupled to said valve disk (40) to retain said valve disk (40) in the open position at motor speeds below a predetermined speed;

said latch means (41,42,43) comprising at least two holding dogs (41) attached to said valve disk (40) and a suspender means (43) rigidly attached to the rotor (17) of said motor (11), said holding dogs (41) being at normal motor speed urged into latching engagement with said suspender means (43) by a spring force obtained by elastic preforming of said elastically deformable valve disk (40), and said holding dogs (41) being responsive to centrifugal action at motor speeds exceeding said predetermined speed to elastically deform said valve disk (40) to release said latching engagement of said holding dogs (41) with said suspender means (43) to thereby permit said valve disk (40) to move towards its said closed position.

2. Motor with overspeed safety device according to claim 1, wherein:

said elastically deformable valve disk (40) is elastically bendable about a diameter line (45);

said holding dogs (41) are rigidly mounted on said valve disk (40) symmetrically of said diameter line (45); and said valve disk (40) is elastically bent about said diameter line (45) as said holding dogs (41) latchingly engage said suspender means (43).

3. Motor with overspeed safety device according to claim 2, comprising only two holding dogs (41), said two holding dogs (41) being located at opposite sides of said diameter line (45).

4. Motor with overspeed safety device according to any one of claims 1, 2 or 3, wherein said valve disk (40) is arranged in the pressure air supply passage (24) such that in its open position and at least at said predetermined motor speed it is exposed to a pressure drop generated closing force.

5. Motor with overspeed safety device according to any one of claims 1, 2 or 3, wherein each of said holding dogs (41) is cylindrical and has a peripheral groove (42) therein for engagement with said suspender means (43).

6. Motor with overspeed safety device according to claim 5, wherein said suspender means (43) comprises a steel plate having two parallel, straight edges (44) which are releasably engageable with said grooves (42).

7. Motor with overspeed safety device according to claim 6, wherein said suspender means (43) comprises urging means (46, 48, 49) for engaging and urging said holding dogs (41) in such a direction as to aid in moving said valve disc to said closed position.

8. Motor with overspeed safety device according to claim 7, wherein said urging means comprises at least two wings (46) on said suspender plate (43), one wing (46) being associated with one of said holding dogs (41), said wings each having an inclined portion to act upon a holding dog (41) to aid in urging said valve disc (40) to said closed position.

9. Motor with overspeed safety device according to any one of claims 1, 2 or 3, wherein said suspender means (43) comprises urging means (46,48,49) for engaging and urging said holding dogs (41) in such a direction as to aid in moving said valve disc to said closed position.

10. Motor with overspeed safety device according to claim 9, wherein said urging means comprises at least two wings (46) on said suspender means (43), one wing (46) being associated with one of said holding dogs (41), said wings each having an inclined portion to act upon a holding dog (41) to aid in urging said valve disc (40) to said closed position.

* * * * *